United States Patent [19]

Gebhardt

[11] 3,955,520

[45] May 11, 1976

[54] SEWING MACHINE LOOP TAKER MOUNTING

[75] Inventor: Adolph Armor Gebhardt, Chatham, N.J.

[73] Assignee: The Singer Company, New York, N.Y.

[22] Filed: July 22, 1975

[21] Appl. No.: 598,513

[52] U.S. Cl. ..... 112/256

[51] Int. Cl.[2] ..... D05B 71/02

[58] Field of Search ..... 112/256, 181, 183, 184, 112/228, 189

[56] References Cited

UNITED STATES PATENTS

| | | | |
|---|---|---|---|
| 2,762,325 | 9/1956 | Hale et al. | 112/256 |
| 3,060,877 | 10/1962 | Ketterer | 112/256 |
| 3,294,049 | 12/1966 | Ketterer et al. | 112/256 |
| 3,513,794 | 5/1970 | Bernewasser | 112/256 |

*Primary Examiner*—H. Hampton Hunter
*Attorney, Agent, or Firm*—Robert E. Smith; Julian Falk; Edward L. Bell

[57] ABSTRACT

A sewing machine loop taker mounting on a drive shaft formed with a loop taker lubricating conduit in which oil leakage out of the mounting is eliminated. The drive shaft is formed with a socket accommodating a hub on the loop taker so that the hub may be formed with a tapered bore into which the head of a lubricant metering screw on the shaft projects.

7 Claims, 1 Drawing Figure

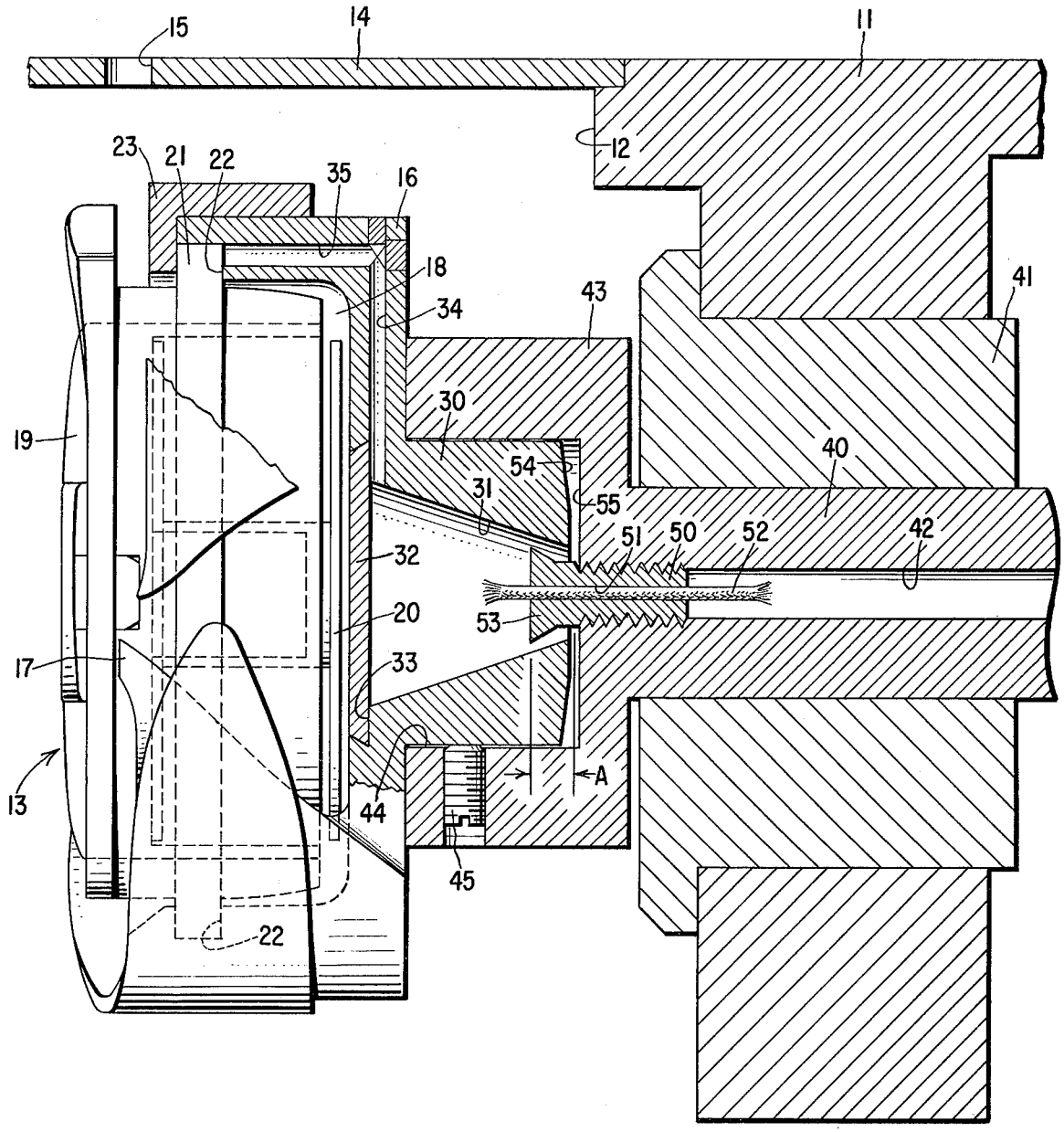
15
14
11
12
23
21
22
35
16
18
34
43
41
30
19
54
40
31
55
51
50
52
42
32
20
53
17
33
13
44
A
45
22

SEWING MACHINE LOOP TAKER MOUNTING

BACKGROUND OF THE INVENTION

Sewing machine loop takers, and particularly rotary hooks used in industrial sewing machines, include bearing surfaces within the loop taker between the moving and stationary parts which require lubrication in exceedingly exacting amounts sufficient to minimize friction and heat and yet not in excess which would stain and damage the work fabrics being stitched. It is conventional to direct lubricant to such sewing machine loop takers through a conduit in the loop taker drive shaft, however, a problem arises because the loop taker must be detachable from the drive shaft for replacement and repair and the loop taker mount on the shaft is also required to be capable of accommodating limited adjustment so that timing and positional adjustments of the loop taker relatively to the sewing machine needle can be made in a practical way. Oil leakage out of such loop taker mounts has been a problem with the prior art constructions, and as a result, it is conventional to associate oil slings and other protective devices with conventional loop taker mounts to guard against staining of the machine operator's clothing as well as staining of work fabrics being stitched. Such oil slings and guards have involved additional expense and they have usurped space in a critically crowded area in the sewing machine.

SUMMARY OF THE INVENTION

It is an object of this invention to provide a loop taker mounting using the same number of parts used in the most common prior art form but in which the parts have been restructured so that lubricant leakage from the drive shaft lubricant conduit to the loop taker raceway is effectively eliminated. This object is attained by a mounting arrangement in which a socket is formed on the drive shaft to accommodate a hub formed on the loop taker and in which a tapered bore in the loop taker hub overlaps the head of a lubricant metering screw threaded into the lubricant conduit in the drive shaft.

DESCRIPTION OF THE DRAWING

The accompanying drawing illustrates a horizontal cross-sectional view of a portion of a sewing machine showing a loop taker mounting on a drive shaft illustrating a preferred form of this invention.

DESCRIPTION OF THE INVENTION

As shown in the accompanying drawing, 11 indicates a portion of the work supporting bed of a sewing machine including a compartment 12 in which a loop taker indicated generally at 13 is located. The compartment 12 is closed at the top by a throat plate 14 which supports the work to be stitched against the thrust of a needle (not shown) which reciprocates through a needle aperture 15 in the throat plate in cooperation with the loop taker in the formation of stitches.

The loop taker 13 illustrated in the accompanying drawing is a rotary hook, which as is well known in the sewing machine art, includes a body portion 16 adapted to be rotated and formed with a thread loop seizing beak 17 for engaging thread from the needle. The rotary hook also includes a cavity 18 for accommodating a bobbin case 19 which is held against movement with the body portion by rotation restraining means (not shown). The bobbin case houses a supply of locking thread usually carried on a bobbin 20 accommodated in the bobbin case. The bobbin case is formed with a bearing rib 21 journaled in a raceway 22 formed partly in the body portion 16 of the rotary hook and partly by a removable gib 23 thereon.

The rotary hook is formed with a hub 30 preferably made integrally therewith and the hub 30 serves not only as a means for attachment of the rotary hook to a driving element, but also as the carrying route for lubricant which is directed to the raceway 20. The hub 30 is formed with an internal bore 31 which is tapered preferably uniformly, being enlarged in diameter toward the hook body portion 16. A closure disc 32 is snapped into an under cut seat 33 in the hook body 16 to seal the bore 31 from the bobbin case accommodating cavity 18. A radial conduit 34 is formed in the hook body portion leading from the tapered bore 31 and a lateral conduit 35 joins the radial conduit with the raceway 22.

As shown in the accompanying drawing, a drive shaft 40 for the loop taker 13 is journaled in a bearing 41 in the sewing machine bed. The drive shaft is formed with an axial bore 42 through which lubricant is conducted for delivery to the loop taker raceway. Oil may be introduced to the bore 42 by any known means such as a pump, gravity system, or the like. For accommodating the loop taker hub 30, the drive shaft at one extremity is provided with an enlarged flange 43 formed with a cylindrical bore 44 into which the exterior of the loop taker hub 30 fits. One or more set screws 45 threaded in the flange 43 may be used to secure the loop taker to the drive shaft with a considerable range of axial and angular adjustment therebetween.

Threaded into the extremity of the bore 42 of the drive shaft is a lubricant metering screw 50 formed with a through bore 51 preferably having a wick 52 forced therein. The screw 50 projects from the shaft bore 42 into the cylindrical bore 44 in the flange 43 and the free extremity of the lubricant metering screw is preferably formed with an enlarged conically shaped head 53.

As shown in the accompanying drawing, the head 53 of the oil metering screw 50 and the tapered bore 31 in the loop taker hub 30 overlap a distance indicated at A, and it will be understood that the overlap A will vary depending upon the axial position of adjustment of the loop taker relatively to the drive shaft.

The taper of the loop taker hub bore 31 provides a preferred means for encouraging flow of any oil which may contact the bore toward the loop taker body portion 16 and toward the conduit 34 therein. Other means such as a spiral groove or the like might also serve in this capacity. The tapered bore 31, particularly in the overlap area A, also serves as a means for preventing lubricant from flowing toward the free extremity 54 of the loop taker hub where the oil leak out the back of the loop taker. Again other means such as an annular fin or the like, may be employed in place of the taper to discourage oil flow toward the free extremity of the hub.

The tapered head 53 of the oil metering screw 50 similarly provides a deterrent for flow of oil along the exterior of the metering screw 50 to the base 55 of the cylindrical bore 44 where the oil might leak out the back of the loop taker, and shapes other than conical might serve on the metering screw head to deter flow of lubricant toward the base 55 of the bore 44.

The lubricant which flows through the wick 52 in metered quantities will flow outwardly on the conical screw head 53 and fall onto the tapered bore 31 in the loop taker hub, either by gravity, if the loop taker is not being rotated, or by centrifugal force when the loop taker is being rotated. The lubricant will then be directed toward the loop taker body portion 16 through the conduits 34 and 35 and to the raceway 22.

This invention thus provides an exceedingly simple and practical arrangement for mounting a loop taker on a drive shaft with the provision for lubricant flow therebetween without lubricant leakage.

Having set forth the nature of this invention, what is claimed herein is:

1. In combination with a sewing machine loop taker having a body portion formed with a bobbin case accommodating raceway, a hub, and lubricant conduits leading from said hub to said raceway, and a drive shaft for said loop taker having a lubricant conducting bore, mounting means for securing said loop taker on said drive shaft comprising: a socket formed at one extremity of said drive shaft communicating with said lubricant conducting bore and snugly accommodating said loop taker hub, fastening means carried by said drive shaft for securing said loop taker hub in said drive shaft socket, said loop taker hub being formed with a lengthwise bore extending from the free extremity of the hub toward said body portion and into communication with said lubricant conduits, means on said hub bore for encouraging lubricant flow along said hub bore toward said lubricant conduits, and means carried by said drive shaft for providing a metered flow of lubricant from said drive shaft lubricant conducting bore to a point intermediate the length of said hub bore.

2. Loop taker mounting means as set forth in claim 1 in which said means for encouraging lubricant flow along said hub bore comprises a continuous conical shape of said hub bore increasing in diameter from said free extremity toward said loop taker body portion.

3. In combination with a sewing machine loop taker having a body portion formed with a bobbin case accommodating raceway, a hub, and lubricant conduits leadng from said hub to said raceway, and a drive shaft for said loop taker having a lubricant conducting bore, mounting means for securing said loop taker on said drive shaft comprising: a socket formed at one extremity of said drive shaft communicating with said lubricant conducting bore and snugly accommodating said loop taker hub, fastening means carried by said drive shaft for securing said loop taker hub in said drive shaft socket, a tube means carried by said drive shaft in lubricant conducting communication at one extremity with said lubricant conducting bore and protruding at the other extremity into said socket, said loop taker hub being formed with a bore extending from the free extremity of said hub toward said body portion and into communication with said lubricating conduits, said protruding extremity of said tube means extending in telescoping relation within said hub bore when said loop taker is secured on said drive shaft, means carried on said tube means within the length overlapped by said hub bore in telescopic relation thereto for deterring lubricant flow externally along said tube means toward said drive shaft, and means on said hub bore within the length overlapped by said tube means in telescopic relation thereto for deterring lubricant flow along said hub bore toward the free extremity toward said hub.

4. Loop taker mounting means as set forth in claim 3 in which said lubricant flow deterring means in said hub bore comprises a conical bore shape decreasing diameter toward said free extremity of said hub.

5. Loop taker mounting means as set forth in claim 3 in which said loop taker hub bore is formed beyond the length overlapped by said tube means in telescopic relation thereto with means for directing flow of lubricant along said bore toward said hub conduits.

6. Loop taker mounting means as set forth in claim 3 in which both said means for deterring lubricant flow toward the free extremity of said hub and the means for directing flow of lubricant along said bore toward said hub conduits are provided by a continuous conical shape of said hub bore increasing in diameter from said free extremity toward said loop taker body portion.

7. Loop taker mounting means as set forth in claim 3 in which said means for deterring lubricant flow externally along said tube means comprises a radially outward projecting head formed on said tube means.

* * * * *